US009680212B2

(12) United States Patent
Konu et al.

(10) Patent No.: US 9,680,212 B2
(45) Date of Patent: Jun. 13, 2017

(54) CAPACITIVE GROUNDING METHODS AND APPARATUS FOR MOBILE DEVICES

(71) Applicant: Pulse Finland Oy, Kempele (FI)

(72) Inventors: Jarmo Konu, Oulu (FI); Prasadh Ramachandran, Oulu (FI); Petteri Annamaa, Oulunsalo (FI)

(73) Assignee: Pulse Finland OY, Oulunsalo (FI)

( * ) Notice: Subject to any disclaimer, the term of this patent is extended or adjusted under 35 U.S.C. 154(b) by 722 days.

(21) Appl. No.: 14/085,093

(22) Filed: Nov. 20, 2013

(65) Prior Publication Data

US 2015/0138021 A1 May 21, 2015

(51) Int. Cl.
*H01Q 1/24* (2006.01)
*H01Q 1/48* (2006.01)

(52) U.S. Cl.
CPC ..... *H01Q 1/48* (2013.01); *H01Q 1/243* (2013.01); *Y10T 29/49117* (2015.01)

(58) Field of Classification Search
CPC ..... H01Q 1/48
USPC ..... 343/702
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Graham Smith
(74) *Attorney, Agent, or Firm* — Gazdzinski & Associates, PC

(57) ABSTRACT

Grounding apparatus for mobile devices and methods of utilizing and manufacturing the same. In one embodiment, an outer metallized surface of a mobile device is configured to capacitively couple a metal back cover to the device ground. Specifically, in one implementation, an exterior surface of the mobile device is metalized and coupled to the device ground via galvanic contacts. The exterior metalized surface is configured to be capacitively coupled a metal back cover of a mobile device to the device ground when the back cover is installed on the mobile device. By capacitively coupling the back cover to the device ground via the exterior metalized surface, the need to otherwise ground the back cover through the use of galvanic contacts is obviated, thereby reducing the number of components needed.

19 Claims, 7 Drawing Sheets

(56) References Cited

U.S. PATENT DOCUMENTS 4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanen
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Maeda et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.

(56) References Cited

U.S. PATENT DOCUMENTS 5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,108 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.

(56) References Cited

U.S. PATENT DOCUMENTS

| | | | |
|---|---|---|---|
| 6,967,618 | B2 | 11/2005 | Ojantakanen |
| 6,975,278 | B2 | 12/2005 | Song et al. |
| 6,980,158 | B2 | 12/2005 | Iguchi et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kuriyama et al. |
| 7,034,752 | B2 | 4/2006 | Sekiguchi et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,061,430 | B2 | 6/2006 | Zheng et al. |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,129,893 | B2 | 10/2006 | Otaka et al. |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,215,283 | B2 | 5/2007 | Boyle |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,233,775 | B2 | 6/2007 | De Graauw |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,355,270 | B2 | 4/2008 | Hasebe et al. |
| 7,358,902 | B2 | 4/2008 | Erkocevic |
| 7,375,695 | B2 | 5/2008 | Ishizuka et al. |
| 7,381,774 | B2 | 6/2008 | Bish et al. |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,443,344 | B2 | 10/2008 | Boyle |
| 7,468,700 | B2 | 12/2008 | Milosavlejevic |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka et al. |
| 7,616,158 | B2 | 11/2009 | Mark et al. |
| 7,633,449 | B2 * | 12/2009 | Oh ..... H01Q 1/528 343/702 |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,843,397 | B2 | 11/2010 | Boyle |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,903,035 | B2 | 3/2011 | Mikkola et al. |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,098,202 | B2 | 1/2012 | Annamaa et al. |
| 8,179,322 | B2 | 5/2012 | Nissinen |
| 8,193,998 | B2 | 6/2012 | Puente Baliarda et al. |
| 8,378,892 | B2 | 2/2013 | Sorvala |
| 8,466,756 | B2 | 6/2013 | Milosavljevic et al. |
| 8,473,017 | B2 | 6/2013 | Milosavljevic et al. |
| 8,564,485 | B2 | 10/2013 | Milosavljevic et al. |
| 8,629,813 | B2 | 1/2014 | Milosavljevic |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0137950 | A1 | 7/2004 | Bolin et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2006/0192723 | A1 | 8/2006 | Harada |
| 2007/0042615 | A1 | 2/2007 | Liao |
| 2007/0082789 | A1 | 4/2007 | Nissila |
| 2007/0152881 | A1 | 7/2007 | Chan |
| 2007/0188388 | A1 | 8/2007 | Feng |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2009/0197654 | A1 | 8/2009 | Teshima |
| 2009/0231213 | A1 | 9/2009 | Ishimiya |
| 2010/0220016 | A1 | 9/2010 | Nissinen |
| 2010/0244978 | A1 | 9/2010 | Milosavljevic |
| 2010/0309092 | A1 | 12/2010 | Lambacka |
| 2011/0133994 | A1 | 6/2011 | Korva |
| 2012/0119955 | A1 | 5/2012 | Milosavljevic et al. |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |

(56) References Cited

FOREIGN PATENT DOCUMENTS

| | | |
|---|---|---|
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng- Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.

I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.

International Preliminary Report on Patentability for International Application No. PCT/FI2004/000554, date of issuance of report May 1, 2006.

Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.

Kim, B. C., J. H. Yun, and H. D. Choi, "Small wideband PIFA for mobile phones at 1800 MHz," *IEEE International Conference on Vehicular Technology*, 27(29, Daejeon, South Korea, May 2004.

Kim, Kihong et al., "Integrated Dipole Antennas on Silicon Substrates for Intra-Chip Communication", IEEE, pp. 1582-1585, 1999.

Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71(86, 2004.

K-L Wong, *Planar Antennas for Wireless Communications*, Hoboken, NJ: Willey, 2003, ch. 2.

Lindberg., P. and E. Ojefors, "A bandwidth enhancement technique for mobile handset antennas using wavetraps," *IEEE Transactions on Antennas and Propagation*, vol. 54, 2226{2232, 2006.

(56) References Cited

OTHER PUBLICATIONS

Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", Electronic Letters, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat. Soc. Int, Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'An, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013 issued by the EPO for EP Patent Application No. 12177740.3.

* cited by examiner

CAPACITIVE GROUNDING METHODS AND APPARATUS FOR MOBILE DEVICES

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna apparatus for use in electronic devices such as wireless or portable radio devices, and more particularly in one exemplary aspect to space-efficient grounding apparatus and methods of manufacturing and use.

DESCRIPTION OF RELATED TECHNOLOGY

Internal antennas are commonly found in most modern radio devices, such as mobile computers, tablets, mobile phones, Blackberry® devices, smartphones, personal digital assistants (PDAs), or other personal communication devices (PCD). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Recent advances in the development of affordable and power-efficient display technologies for mobile applications (such as liquid crystal displays (LCD), light-emitting diodes (LED) displays, organic light emitting diodes (OLED), thin film transistors (TFT), etc.) have resulted in a proliferation of mobile devices featuring large displays, with screen sizes of up to 180 mm (7 inches) in some tablet computers and up to 500 mm (20 inches) in some laptop computers.

Furthermore, current trends increase the demand for thinner mobile communications devices with large displays that are often used for user input (touch screen). This in turn requires a rigid structure to support the display assembly, particularly during the touch-screen operation, so as to make the interface robust and durable, and mitigate movement or deflection of the display. A metal body or a metal frame is often utilized to provide a better support for the display in the mobile communication device consistent with these requirements.

The use of metal enclosures/chassis and smaller thickness of the device enclosure create new challenges for radio frequency (RF) antenna implementations. Typical antenna solutions (such as monopole, PIFA antennas) require a ground clearance area and sufficient height from the ground plane in order to operate efficiently in multiple frequency bands. These antenna solutions are often inadequate for the aforementioned thin devices with metal housings and/or chassis, as the vertical distance required to separate the radiator from the ground plane is no longer available. Portions of the metal housing may be connected to the device ground through the use of galvanic contacts, and thus factored into the antenna performance. However, the use of numerous galvanic contacts increases material and manufacturing costs, and consumes board space.

Accordingly, there is a salient need for a wireless solution for e.g., a portable radio device with a small form factor metal body and/or chassis that offers a lower cost and complexity, and provides for space-efficient grounding apparatus, and methods of manufacturing and use of the same.

SUMMARY

The present disclosure satisfies the foregoing needs by providing, inter cilia, space-efficient grounding apparatus and methods of use.

In a first aspect, a mobile wireless device is disclosed. In one embodiment, the mobile wireless device includes: one or more antenna elements, a main body portion that includes a metalized surface, and a back cover portion that is at least partly capacitively coupled to a device ground of the mobile wireless device.

In one variant, the at least metalized surface is connected to the device ground via one or more galvanic contacts.

In another variant, the back cover portion is at least partly capacitively coupled to the device ground via the metalized surface.

In a second aspect, an antenna apparatus is disclosed. In one embodiment, the antenna apparatus includes: at least one radiator element that includes a feed point, and a conductive element coupled to the feed point, a dielectric substrate having a plurality of surfaces and further including at least one radiator element and a metal surface, and a ground plane coupled to a ground of a host device, where the metal surface is configured to capacitively couple at least a portion a back cover of the host device to the ground of the host device.

In one variant, the outer metal surface is coupled to the ground of the host device via one or more galvanic contacts.

In yet another variant the metal surface is configured so that performance of the at least one radiator element is substantially independent of the back cover.

In a third aspect, a method for grounding one or more components of a mobile wireless device is disclosed. In one embodiment, the method includes: metalizing at least an exterior portion of a main body of the mobile wireless device, connecting the metalized exterior portion to a ground of the mobile wireless device using at least one galvanic contact, and capacitive coupling at least a portion of a back cover of the mobile wireless device to the metalized exterior portion, the capacitive coupling configured to ground the metalized exterior portion to the ground of the mobile wireless device.

In one variant, the method further includes forming at least one galvanic contact by metalizing an interior portion of the main body.

In another variant, the capacitive coupling is configured to reduce a number of galvanic contacts otherwise required to achieve a performance of grounding of the back cover to the ground of the mobile wireless device.

In a fourth aspect, a method of manufacturing an antenna apparatus is disclosed.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1A:
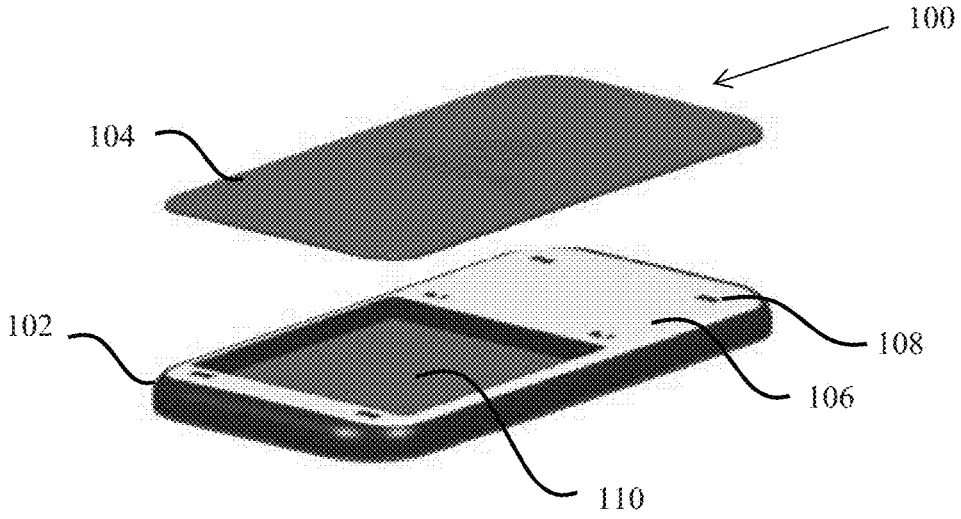
FIG. 1A is a perspective partially exploded view of an exemplary embodiment of a mobile device configured in accordance with the present disclosure.

All Figures disclosed herein are © Copyright 2013 Pulse Finland Oy. All rights reserved.

DETAILED DESCRIPTION

Reference is now made to the drawings, wherein like numerals refer to like parts throughout.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

The terms "near field communication" and "NFC" refer without limitation to a short-range high frequency wireless communication technology which enables the exchange of data between devices over short distances such as described by ISO/IEC 18092/ECMA-340 standard and/or ISO/ELEC 14443 proximity-card standard. As used herein, the terms "portable device", "mobile device", "client device", "portable device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Furthermore, while primarily discussed in terms of manufacturing using methods such as laser direct structuring (LDS), it is recognized that the antenna embodiments discussed herein may be readily manufactured from other known methods including, for example: (1) flexible substrates; (2) sheet metal fabrication techniques; (3) fluid or vapor deposition; (4) "2-shot" molding; (5) pad printing; and (6) print deposition can be used to manufacture the various components as applicable, such techniques and structures being readily determined by those of ordinary skill when given the present disclosure.

Overview

In one salient aspect, the present disclosure provides improved grounding apparatus, and methods of manufacturing and using the same. In one embodiment, an outer metallized surface of a mobile device is configured to capacitively couple a metal back cover to the device ground. Specifically, in one implementation, an exterior surface of the mobile device is metalized and coupled to the device ground via galvanic contacts. The exterior metalized surface is configured to be capacitively coupled a metal back cover of a mobile device to the device ground when the back cover is installed on the mobile device. By capacitively coupling the back cover to the device ground via the exterior metalized surface, the need to otherwise ground the back cover through the use of galvanic contacts is obviated, thereby reducing the number of components needed. Furthermore, as the exterior metalized surface is configured to implement capacitive coupling to ground via galvanic contacts (as compared to galvanic contacts connected directly to the back cover), the placement of galvanic contacts connected to the exterior metalized surface may be moved to more suitable locations that would have otherwise been dictated by physical constraints between the mobile device and the back cover.

In addition, as no direct physical contact between the back cover and the device ground is necessary, reliability of the grounding is improved, since the back cover grounding is not subject to failures such as failure of metal-to-metal joint bonding of the galvanic contacts between the back cover and the mobile device ground.

In one implementation, the exterior metalized surface is configured to achieve antenna performance substantially independent of the material composition of the back cover of the mobile device. Accordingly, one salient advantage provided by the exemplary embodiments of the grounding apparatus is the provision of enhanced design freedom of the back cover, without effecting antenna (electrical) performance or that of the host mobile device.

Detailed Description of Exemplary Embodiments

Detailed descriptions of the various embodiments and variants of the apparatus and methods of the present disclosure are now provided. While primarily discussed in the context of mobile devices, the various apparatus and methodologies discussed herein are not so limited. In fact, many of the apparatus and methodologies described herein are useful in any number of complex antennas, whether associated with mobile or fixed devices that can benefit from the grounding methodologies and apparatus described herein.

Exemplary Mobile Device Configuration

Figure 1B:
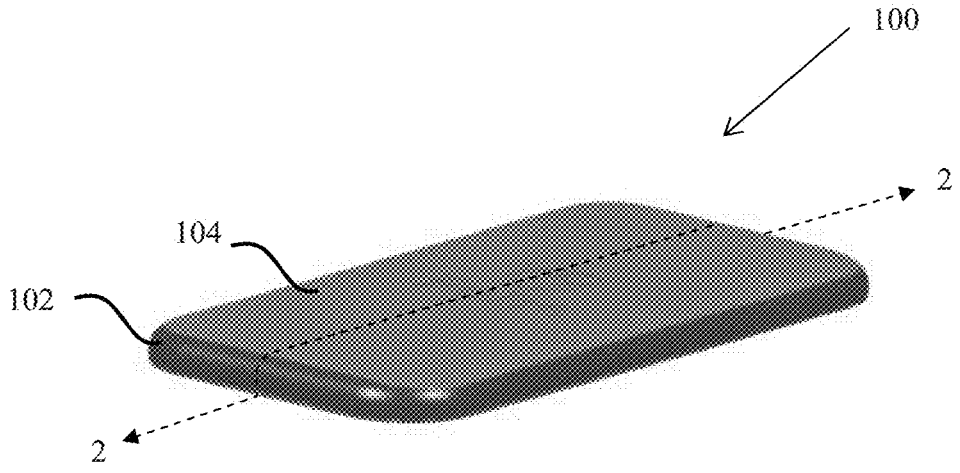
FIG. 1B is a perspective view of the exemplary mobile device of FIG. 1A.

Referring now to FIG. 1, an exemplary embodiment of a mobile device 100 configured in accordance with the principles of the present disclosure is shown and described. In this embodiment, the mobile device 100 comprises a device body 102 and a back cover 104. The device body 102 comprises an outer metallized surface 106, and is configured to house the internal components of the mobile device 100, such as for example a chassis, one or more printed circuit boards, antenna assemblies, display components, one or more user interfaces, etc.

In one implementation, the outer metalized surface 106 is formed on the device body 102 using a laser direct structuring (LDS) process. Specifically, advances in manufacturing processes have enabled the construction of metallized structures directly onto the surface of a specialized material (e.g., a thermoplastic material that is doped with a metal additive). The doped metal additive is activated by means of a laser, which enables the construction of metallized component features onto more complex three-dimensional geometries. A laser is then used to activate areas of the (thermoplastic) material that are to be subsequently plated. An electrolytic copper bath followed by successive additive layers (such as nickel or gold) can then be added if needed to complete the construction of the metallized structures. LDS processes are well known to those of ordinary skill in the art, and accordingly are not described further herein.

In another implementation deposition of the conductive fluid for the outer metalized surface 106 is accomplished using the techniques described in co-owned and co-pending U.S. patent application Ser. No. 13/782,993 filed Mar. 1, 2013 and entitled "DEPOSITION ANTENNA APPARATUS AND METHODS", incorporated herein by reference in its entirety, although it will be appreciated that other approaches may be used in place of or in conjunction with the foregoing.

The device body 102 is further configured with a plurality of galvanic grounding elements 108 which are in electrical connection with the outer metallized surface 106. The device body 102 further comprises a cavity 110 to contain at least a battery component (not shown). However, any number of physical features may be formed into the device body 102 depending on device application as would be readily apparent to a person of skill. In one implementation, the back cover 104 is composed at least partly of metal, which is grounded to the outer metallized surface 106 via capacitive coupling. The outer metallized surface 106 coupled to the back cover 104 defines the top lip of the electrical "box" of the mobile device 100 useful in maintaining consistent antenna performance of the mobile device 100.

Figure 2:
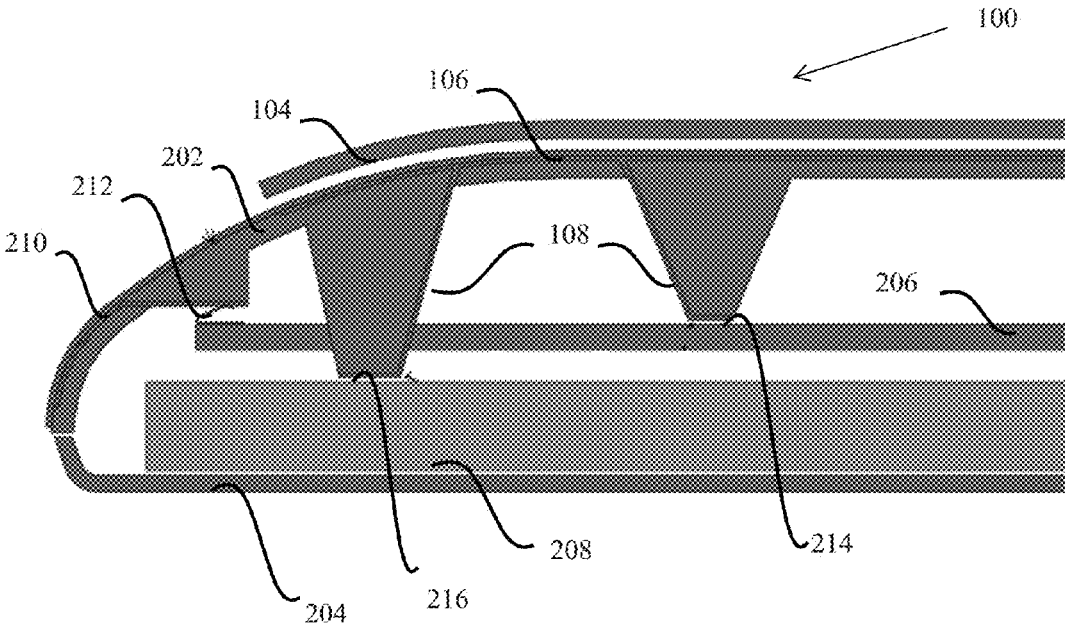
FIG. 2 is a cross-sectional view of the mobile device of FIGS. 1A-1B, taken along line 2-2.

Referring now to FIG. 2, a cross-sectional view of mobile device 100 of FIG. 1 is shown and described. In one embodiment, the device body 102 comprises a middle deck 202 and a front body portion 204. The middle deck 202 and front body portion 204 are fabricated from any suitable dielectric material (e.g., plastic, glass, zirconia) and are attached to one another by any of a variety of suitable means, such as e.g., adhesive, press-fit, heat staking, snap-in with support of additional retaining members (not shown), or the like. Alternatively, the middle deck 202 and/or the front body portion 204 may be fabricated from a non-conductive film, or non-conductive paint bonded onto one or more exterior surfaces, or any combination of the foregoing.

Within device body 102, a main board 206 and display component 208 are contained, although numbers other types of components may be housed with the device body 102, as would be recognizable by a person of skill. In one variant, the display component 208 comprises a display-only device configured only to display content or data. In another embodiment, the display component 208 is a touch screen display (e.g., capacitive, resistive, or other technology) that allows for user input into the device via the display component 208. The display component 208 may comprise, for example, a liquid crystal display (LCD), light-emitting diode (LED) display, organic light emitting diode (OLED) display, or TFT-based device. It is appreciated by those skilled in the art that methodologies of the present disclosure are equally applicable to any future display technology, provided the display module is generally mechanically compatible with configurations such as those described in FIG. 1-FIG. 2.

In one embodiment, the middle deck 202 comprises one or more antenna elements 210. The main board 206 comprises a printed circuit board containing various components of the mobile device 100. Additionally, the one or more antenna elements 210 and main board 206 are configured to be in electrical contact via one or more antenna contacts 212. In one variant, the one or more antenna elements 210 are affixed to the mobile device 100 via a conductive "sponge" (i.e., conductive foam material) at the ground coupling point, and to the feed point via antenna contact 212. In another variant, both above connections are effected via solder joints. In yet another variant, both connections are effected via a conductive sponge. Other electrical coupling methods are useable with embodiments of the present disclosure including, but not limited to, c-clips, pogo pins, heat staking, etc. Additionally, a suitable adhesive or mechanical retaining means (e.g., snap fit) may be used if desired to affix an antenna element 210 to the mobile device 100 housing.

In one embodiment, each antenna element 210 is configured to operate in a separate frequency band (e.g., one antenna element 210 in a lower frequency band, and one antenna element 210 in an upper frequency band), although it will be appreciated that less or more and/or different bands may be formed based on varying configurations and/or numbers of antenna elements 210.

In one implementation, the lower frequency band (i.e., that associated with one of the two radiating elements operating at lower frequency) comprises a sub-GHz Global System for Mobile Communications (GSM) band (e.g., GSM710, GSM750, GSM850, GSM810, GSM900), while the higher band comprises a GSM1900, GSM1800, or PCS-1900 frequency band (e.g., 1.8 or 1.9 GHz).

In another implementation, the low or high band comprises the Global Positioning System (GPS) frequency band, and the antenna is used for receiving GPS position signals for decoding by e.g., an internal GPS receiver. In one variant, a single upper band antenna assembly operates in both the GPS and the Bluetooth frequency bands.

In another variant, the high-band comprises a Wi-Fi (IEEE Std. 802.11) or Bluetooth frequency band (e.g., approximately 2.4 GHz), and the lower band comprises GSM1900, GSM1800, or PCS1900 frequency band.

In yet another variant, two or more antennas elements, configured in accordance with the principles of the present disclosure, operate in the same frequency band thus providing, inter alia, diversity for Multiple In Multiple Out (MIMO) or for Multiple In Single Out (MISO) applications.

In another implementation, one of the frequency bands comprises a frequency band suitable for Near Field Communications applications, e.g., ISM 13.56 MHz band.

Other variants are configured the one or more antenna elements to cover LTE/LTE-A (e.g., 698 MHz-740 MHz, 900 MHz, 1800 MHz, and 2.5 GHz-2.6 GHz), WWAN (e.g., 824 MHz-960 MHz, and 1710 MHz-2170 MHz), and/or WiMAX (2.3, and 2.5 GHz) frequency bands.

In one embodiment, a portion of the middle deck 202 comprises the metalized outer surface 106. The middle deck 202 further comprises galvanic grounding elements 108, at least a portion of which are in electrical connection with the outer metalized surface 106. In one implementation, the galvanic grounding elements 108 comprise metallized portions of the middle deck 202. The metalized portions of the galvanic grounding elements 108 may be achieved via an LDS or similar plating process, via deposition (e.g., conductive fluid deposition as previously referenced), or other. The size and shape of the underlying structures of the galvanic grounding elements 108 may be configured based on a specific implementation so that the galvanic grounding elements 108 form contact with internal structures and components of the mobile device 100.

In another implementation, the galvanic grounding elements 108 are of separate construction from the middle deck 202. For example, the galvanic grounding elements 108 may comprise plated screw towers to ground the middle deck 202 to various components of the mobile device 100.

The galvanic grounding elements 108 are connected to various grounding contacts of various components housed within device body 102, such as grounding contact pads 214, 216 on the main board 206 and/or the display component 208.

In one embodiment, the back cover 104 is at least partly comprised of a metal. The metalized outer surface 106, in conjunction with the galvanic grounding elements 108, are configured to capacitively couple with at least a portion of the metal portion of the back cover 104 in order to ground the back cover 104. As the metal portions of the back cover 104 are coupled to the same ground of the metalized outer surface, the effect of the capacitively coupled metal portions impact on antenna performance can be made negligible in comparison to metalized outer surface 106. The amount of capacitive coupling between the back cover 104 and the outer metalized surface 106 is controllable by one or more of the size of the metal portion of the back cover 104, the size of the outer metalized surface 106, the distance between the back cover 104 and the outer metalized surface 106, and the dielectric material separating the metal portions of the back cover 104 and outer metalized surface 106 (such as non-conductive paint, air, etc.), or any combination thereof as would be recognizable by a person of ordinary skill. Salient advantages of a back cover 104 comprised of metal are improved strength of the mobile device 100 in addition to providing enhanced aesthetics. In one implementation, the surface area size of the metalized outer surface and the back cover 104 is substantially the same. One salient advantage of the capacitive coupling of the back cover 104 to ground is obviation of use of galvanic contacts to otherwise ground the back cover 104. Thus, reliability of the ground is increased due to a not requiring a direct physical connection to ground. In addition, reducing the number of galvanic contacts reduces manufacturing cost, and the amount of board space needed on main board or within the mobile device 100. Furthermore, as the galvanic grounding elements 108 are in electrical connection with the outer metallized surface 106, the galvanic grounding elements 108 may be physically located relatively freely with respect to the physical configuration of the back cover 104, which would otherwise be limited by physical constraints of grounding the back cover 104 physically directly to the mobile device 100. Thus, placement of the galvanic grounding elements 108 may be moved to more suitable locations given other design constraints such as, for example, main board size, internal component placement design, etc. For example, the galvanic grounding elements 108 may be moved to locations suitable for defining the electrical "box" of the mobile device 100, such as being located at the corner(s) and/or side edge(s). However, the galvanic grounding elements 108 may be located at a middle portion of the mobile device 100.

In one implementation, the back cover 104 is solely grounded via capacitive coupling with the outer metallized surface 106. In another variant, the back cover 104 is grounded through both the use of capacitively coupling with the outer metallized surface 106, and one or more galvanic contacts in direct physical connection with the back cover 104 and the device ground. Thus, the use of the capacitive coupling can be used to reduce the number of galvanic contacts of the back cover which may have otherwise been necessary to achieve similar performance, thereby reducing component cost while improving design freedom with regards to placement of the one or more galvanic contacts.

In one implementation, the metalized outer surface 106 is configured with a metallized surface that improves antenna performance, even in the instances where the back cover material has poor conductivity. Thus, the antenna performance, such as the antenna's resonance frequency, is not dependent on the back cover 104 being attached or removed from mobile device 100 thereby improving stability of the antenna performance in view of various back cover configurations. Accordingly, the back cover 104 may be constructed out of a variety of materials such as, for example, stainless steel, gold, aluminum, plastic, leather, etc., affording great design freedom. In one implementation, the back cover 104 can be configured to provide wireless charging to the mobile device 100 such as by the use of, for example, inductive charging technology with a respective charging apparatus.

Figure 3:
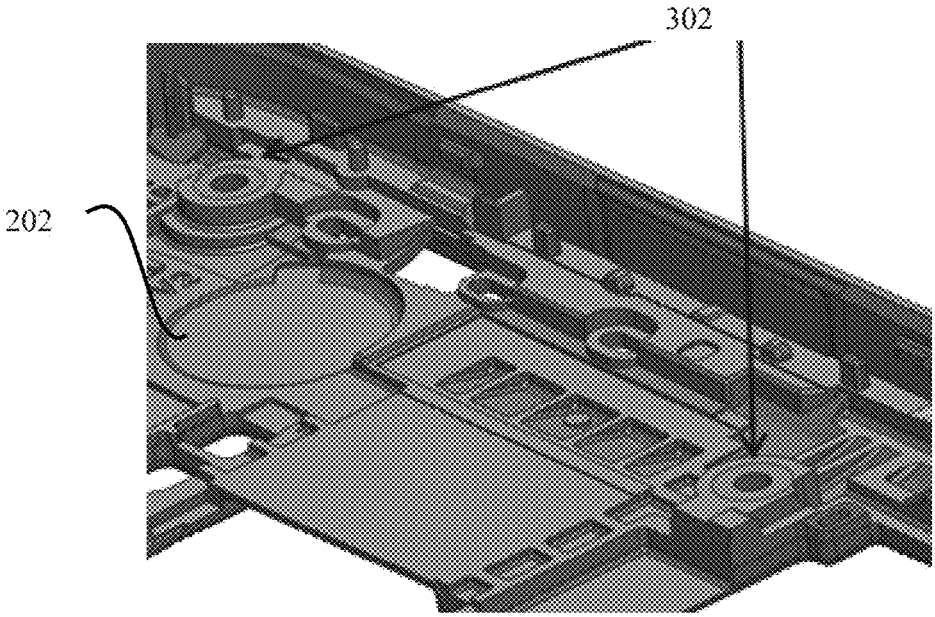
FIG. 3 is an isometric view of an internal surface of a middle deck of the mobile device FIGS. 1A-2.

FIG. 3 illustrates an internal surface of one embodiment of the middle deck 202. The exemplary galvanic grounding elements 108 of FIG. 3 are configured with metallized vias 302 running from the outer metallized surface to form the electrical interface with respective grounding contacts of components within the mobile device 100. However, the electrical interface may be achieved with a variety of methods, such as c-clips, screws, pins, etc.

While the various exemplary embodiments have been presented with respect to capacitive coupling a back cover 104 to ground of a mobile device 100, the present disclosure is not so limited. The present disclosure is equally applicable to capacitive grounding of any portions of the mobile device 100, including other exterior surfaces of the mobile devices 100, in addition to internal components of the mobile device 100. This approach benefits from replacing at least a portion of the galvanic contacts with the capacitive coupled ground, as would be recognized by a person of ordinary skill in the art.

Exemplary Method of Manufacture

Figure 4:
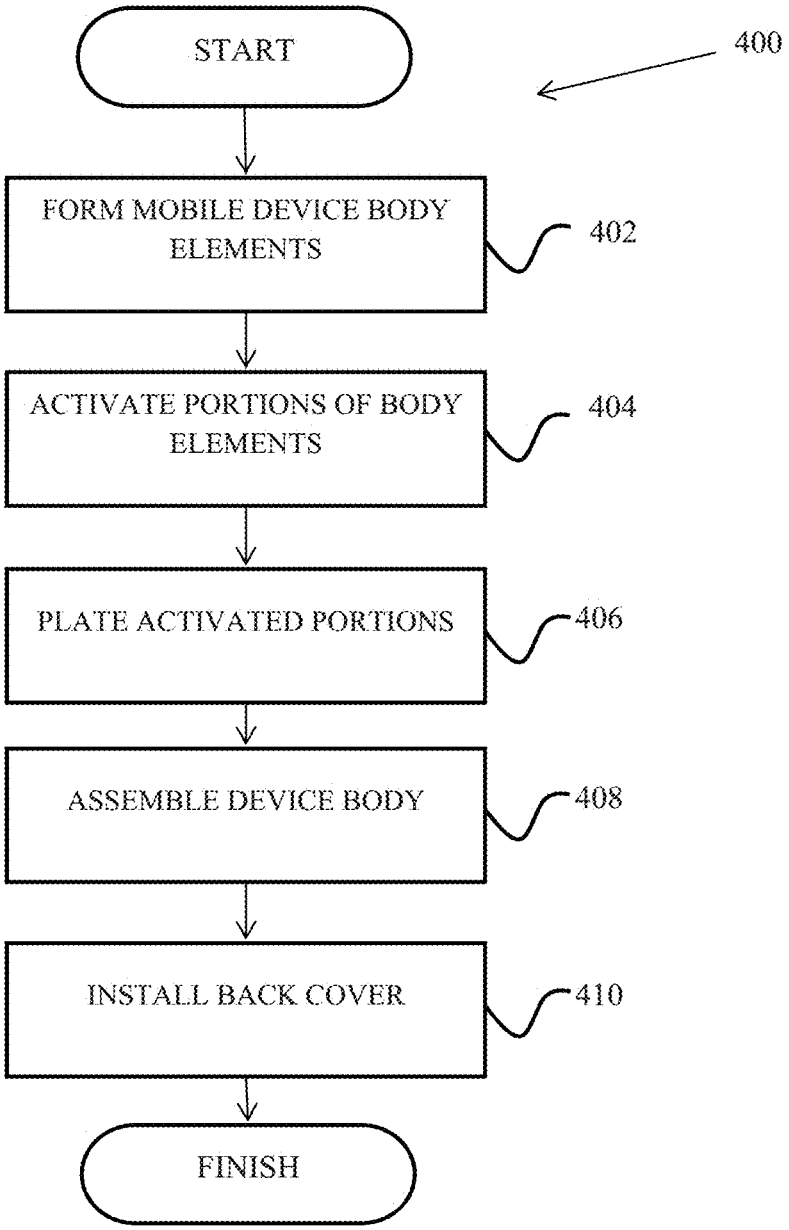
FIG. 4 is a logical flow diagram illustrating one embodiment of a method of manufacturing the grounding apparatus according to the present disclosure.

Referring now to FIG. 4, is a logical flow diagram illustrating one embodiment of a method of manufacturing the mobile device of the present disclosure is shown. While the embodiment of FIG. 4 is described in the exemplary context of mobile device 100 of FIGS. 1-3, it will be appreciated that the method may be readily adapted by those of ordinary skill, when given the present disclosure, to other configurations and embodiments. For example, in the case that a flowable conductive ink or other deposition methodology is used to dispose the metalized portions (e.g., outer metallized surface) of the apparatus, steps necessary (or obviated) for such deposition process can be readily substituted, added, or removed from the illustrated method.

As illustrated, the method 400 includes forming the mobile device body elements (e.g., front portion 204, middle deck 202, and back cover 104) of the mobile device body via a molding or other process per step 402. In one embodiment, the middle deck 202 is formed from a specially selected polymer capable of supporting an LDS process (e.g., which is doped and which can be subsequently laser activated for LDS element formation). In one implementation, the middle deck 202 is formed with structures to be used to form galvanic grounding elements 108.

Next, per step 404, the various portions of the mobile device body elements are activated, such as via laser energy, in preparation for metallic layer deposition via LDS.

Then, per step 406, the activated portions are "plated" via the LDS process, so as to form any or all of the outer metallized surface 106 and the galvanic grounding elements 108, as dictated by the design.

Per step 408, the device body 102 is assembled. In one embodiment, the device body 102 is assembled by connecting the middle deck 202 and front body portion 204 along with inserting any internal component(s) of the mobile device 100 (e.g. main board 204, display component 206, fasteners, wires, etc.).

Lastly, the back cover 204 is installed, as well as any other remaining components (e.g., battery component) onto the device body 102 by affixing back cover 104 per step 410. The mobile device 100 may then be tested, labeled, and/or otherwise prepared if/as desired.

Performance

Figure 5:
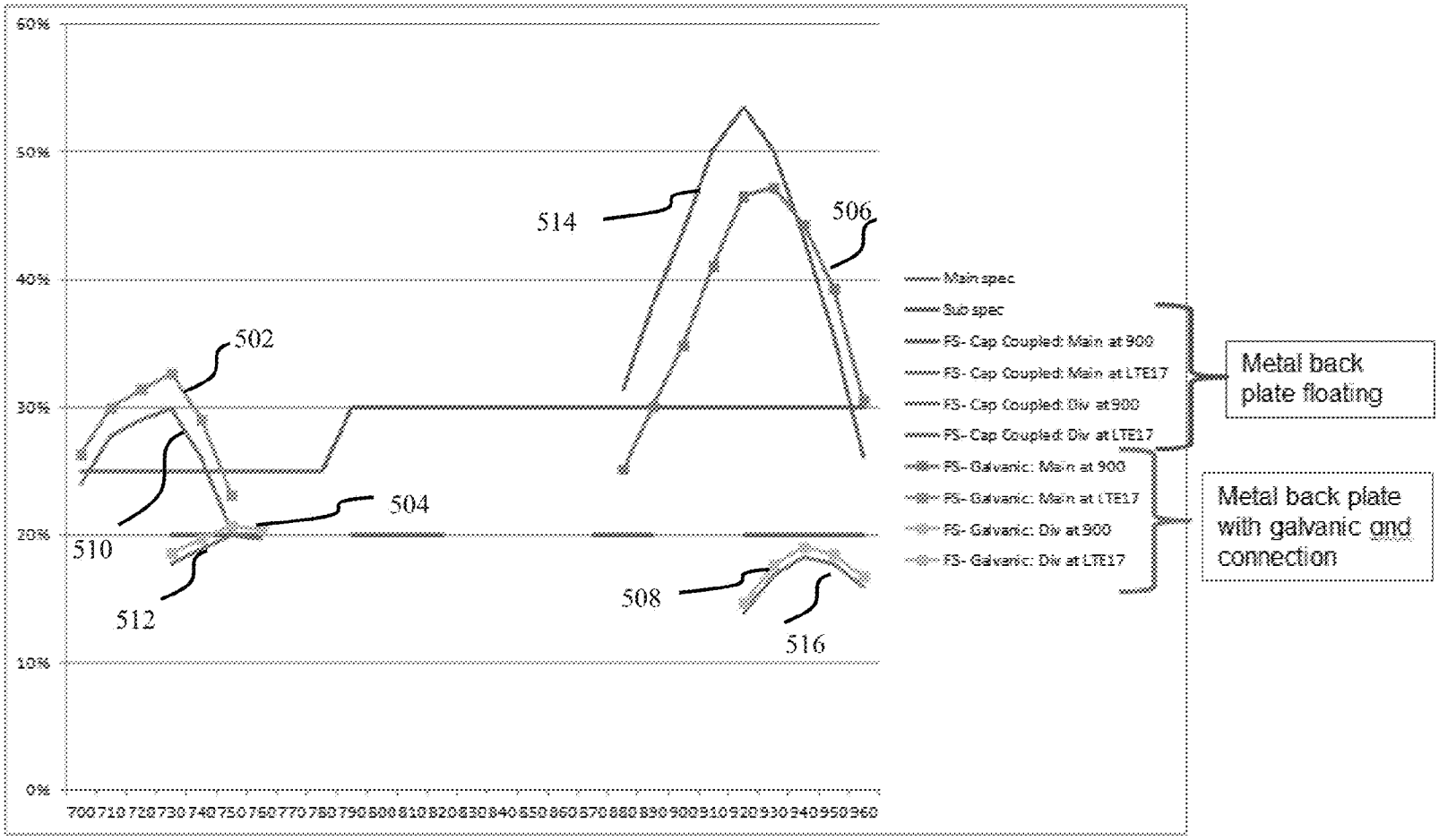
FIG. 5 is a graph of measured free-space efficiency (percentage) as a function of frequency, measured with main and division antenna components of the exemplary embodiment of the mobile device, comparing performance in a low band (i.e. 900 MHz and LTE-band 17) of a galvanic connected metal back plate versus a capacitive coupled back cover.
Figure 6:
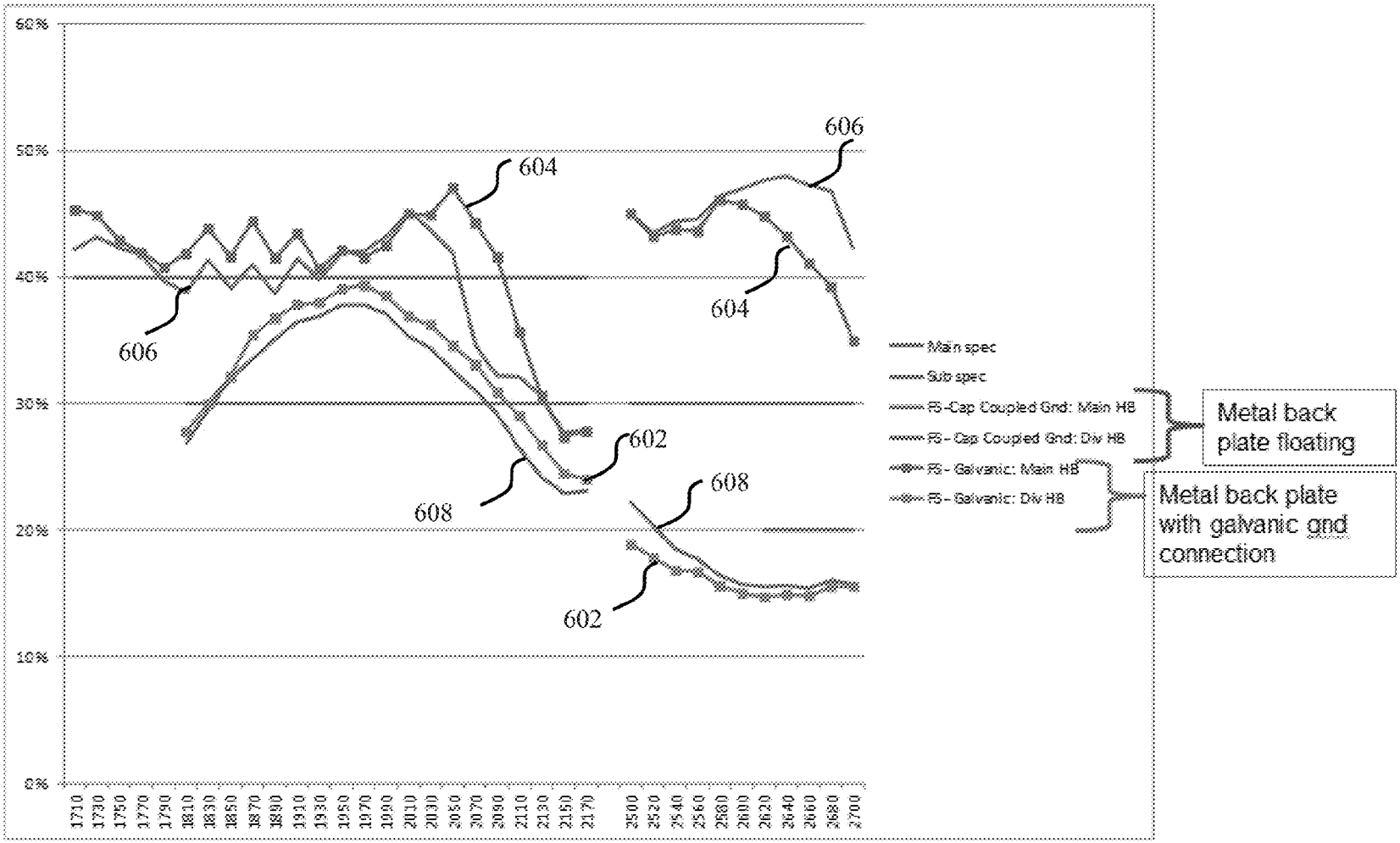
FIG. 6 is a graph of measured free-space efficiency (percentage) as a function of frequency, measured with main and divisional antenna components of the exemplary embodiment of the mobile device, comparing performance in a high band of a galvanic connected metal back plate versus a capacitive coupled back cover.
Figure 7:
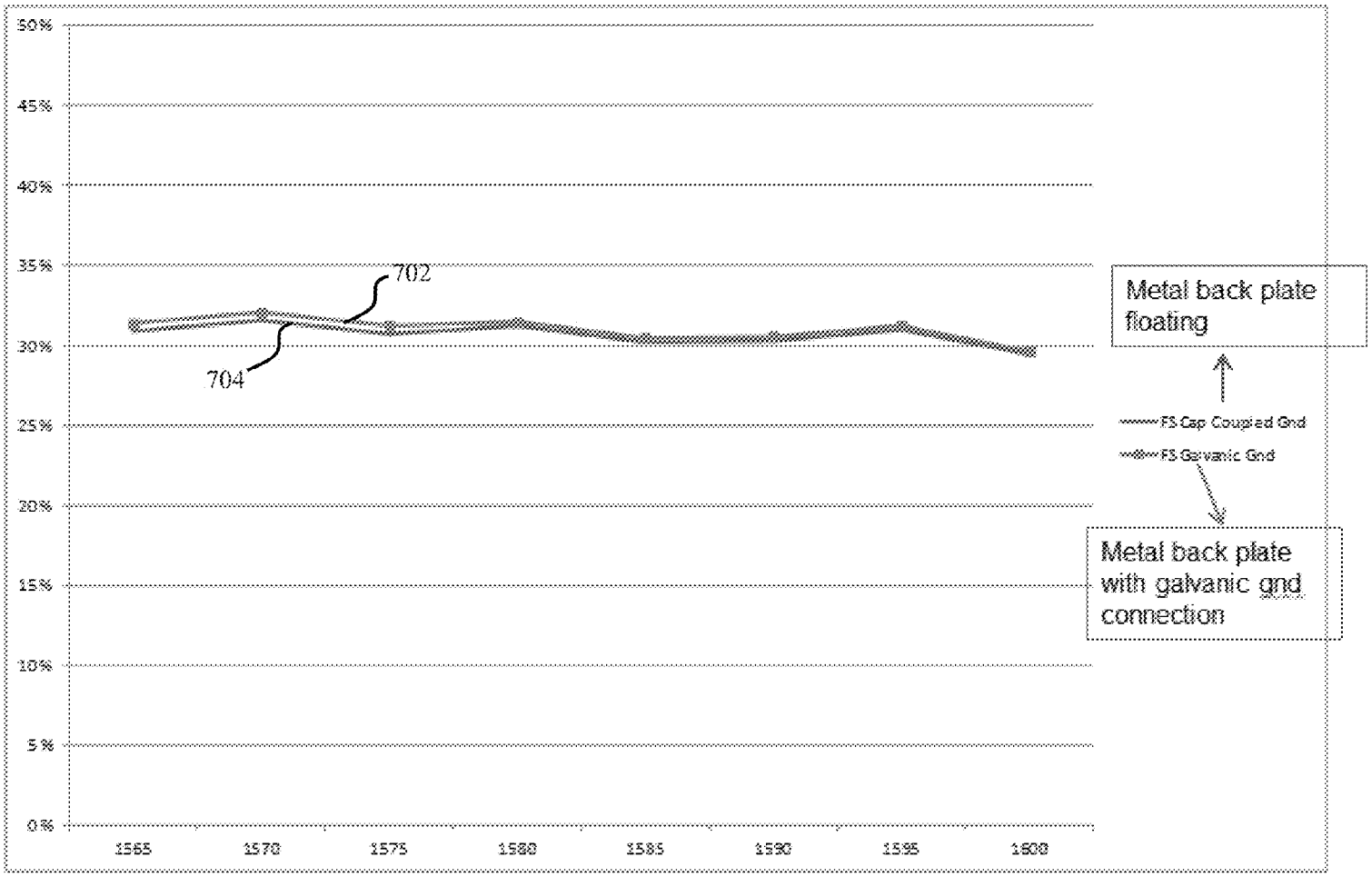
FIG. 7 is a graph of measured free-space efficiency (percentage) as a function of frequency, measured with Global Positioning System (GPS) antenna components of the exemplary embodiment of the mobile device, demonstrating comparable performance a galvanic connected metal back plate versus a capacitive coupled back cover.

Referring now to FIGS. 5 through 7, performance results obtained during testing by the Assignee hereof of an exemplary mobile device constructed according to the present disclosure are presented.

FIG. 5 presents data regarding measured free-space efficiency (percentage) as a function of frequency, measured with main and division antenna components of the mobile device comparing performance in a low band (i.e. 900 MHz and LTE-band 17) of a galvanic connected metal back plate versus a capacitive coupled back cover 104 configured in accordance with the present disclosure.

$$AntennaEfficiency = \left(\frac{\text{Radiated Power}}{\text{Input Power}}\right) \times 100\% \qquad \text{Eqn. (1)}$$

Exemplary data for the lower frequency bands show comparable performance of the main and divisional antenna components of the mobile device in the low band between the galvanic connected metal back plate (502, 504, 506, 508) and the capacitive coupled back cover 104 (510, 512, 514, 516).

FIG. 6 presents data regarding measured free-space efficiency (percentage) as a function of frequency, measured with main and divisional antenna components of the mobile device comparing performance in a high band of a galvanic connected metal back plate versus a capacitive coupled back cover 104 configured in accordance with the present disclosure. As shown by FIG. 6, performance of the galvanic connected back plate (602, 604) is comparable to the performance of the capacitive coupled back cover (606, 608).

FIG. 7 presents data regarding measured free-space efficiency (percentage) as a function of frequency, measured with Global Positioning System (GPS) antenna components of the mobile device demonstrating comparable performance a galvanic connected metal back plate (702) versus a capacitive coupled back cover (704) configured in accordance with the present disclosure.

It will be recognized that while certain aspects of the disclosure are described in terms of a specific sequence of steps of a method, these descriptions are only illustrative of the broader methods of the present disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure as discussed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A mobile wireless device, comprising:

one or more antenna elements;

a main body portion, said main body portion comprising at least a metalized surface, at least a portion of said metalized surface being disposed on an external surface of said main body portion; and a back cover portion, said back cover portion at least partly capacitively coupled to a device ground of said mobile wireless device via said metalized surface of said main body portion;

wherein said metalized surface is disposed between said back cover portion and said device ground, said metalized surface being galvanically coupled to said device ground.

2. The mobile wireless device of claim 1, wherein said at least metalized surface is connected to said device ground via one or more galvanic contacts.

3. The mobile wireless device of claim 1, wherein the main body portion comprises a middle deck, said middle deck comprising at least a portion of said one or more galvanic contacts.

4. The mobile wireless device of claim 2, wherein said capacitive coupling to said device ground is configured to reduce a number of galvanic contacts necessary to achieve substantially similar performance of at least one or said one or more antenna elements.

5. The mobile wireless device of claim 4, wherein said performance comprises a resonance frequency of said one or more antenna elements.

6. The mobile wireless device of claim 1, wherein performance of at least one of said one or more antenna elements is substantially independent from placement of said back cover portion on said mobile wireless device.

7. The mobile wireless device of claim 6, wherein said performance comprises a resonance frequency of said one or more antenna elements.

8. The mobile wireless device of claim 1, wherein performance of at least one of said one or more antenna elements is substantially independent from a construction material of said back cover portion.

9. The mobile wireless device of claim 1, wherein said at least metalized surface is formed on said main body portion using a laser direct structuring (LDS) process.

10. An antenna apparatus, comprising:

at least one radiator element comprising:

a feed point; and a conductive element coupled to said feed point;

a dielectric substrate having a plurality of surfaces, said dielectric substrate comprising said least one radiator element and a metal surface; and a ground plane coupled to a ground of a host device;

wherein said metal surface is configured to capacitively couple at least a portion of a back cover of said host device to said ground of said host device; and wherein said dielectric substrate is disposed between at least said portion of said back cover and said metal surface, and at least a portion of said metal surface is disposed between said dielectric substrate and said ground plane.

11. The antenna apparatus of claim 10, wherein said metal surface comprises an outer surface that is coupled to said ground of said host device via one or more galvanic contacts.

12. The antenna apparatus of claim 11, wherein said dielectric substrate further comprises at least a portion of said one or more galvanic contacts.

13. The antenna apparatus of claim 10, wherein said metal surface is configured so that performance of said at least one radiator element is substantially independent of said back cover.

14. The antenna apparatus of claim 13, wherein said performance comprises a resonance frequency of said at least one radiator element.

15. The antenna apparatus of claim 10, wherein said capacitive coupling is configured to reduce a number of galvanic contacts necessary to achieve substantially similar performance of said at least one radiator element.

16. The antenna apparatus of claim 15, wherein said performance comprises a resonance frequency of said at least one radiator element.

17. A method for grounding one or more components of a mobile wireless device, said method comprising:

metalizing at least an exterior portion of a main body of said mobile wireless device;

connecting said metalized exterior portion to a ground of said mobile wireless device using at least one galvanic contact; and disposing a back cover over said metalized exterior portion of said main body to achieve capacitive coupling of at least a portion of said back cover of said mobile wireless device to said metalized exterior portion, said capacitive coupling configured to ground said metalized exterior portion to said ground of said mobile wireless device.

18. The method of claim 17, further comprising forming said at least one galvanic contact by metalizing an interior portion of said main body.

19. The method of claim 17, wherein said capacitive coupling is configured to reduce a number of galvanic contacts otherwise required to achieve a performance of grounding of said back cover to said ground of said mobile wireless device.

* * * * *